United States Patent [19]

Tani

[11] Patent Number: 4,650,079

[45] Date of Patent: Mar. 17, 1987

[54] EASY-TO-OPEN SYNTHETIC RESIN BAG AND APPARATUS FOR THE MANUFACTURE THEREOF

[75] Inventor: Kanari Tani, Onojo, Japan

[73] Assignee: Kazuhiro Itoh

[21] Appl. No.: 815,282

[22] Filed: Dec. 26, 1985

Related U.S. Application Data

[63] Continuation of Ser. No. 464,991, Feb. 8, 1983, abandoned.

[51] Int. Cl.[4] ..... B65D 27/36; B65D 27/38

[52] U.S. Cl. ..... 206/616; 206/484; 206/484.2; 206/628; 383/66

[58] Field of Search ..... 206/616, 617, 618, 628, 206/484, 484.2, 830; 383/66

[56] References Cited

U.S. PATENT DOCUMENTS

| | | | |
|---|---|---|---|
| 2,820,587 | 1/1958 | Gold et al. | 206/617 |
| 3,042,286 | 7/1962 | Pottle | 206/617 |
| 3,057,539 | 10/1962 | Leary, Jr. | 206/618 |
| 3,246,833 | 4/1966 | Schlienz et al. | 206/618 |
| 3,266,965 | 8/1966 | Spees | 206/616 |
| 3,456,780 | 7/1969 | Forman | 206/616 |
| 3,494,538 | 2/1970 | Matthews | 206/616 |
| 3,668,061 | 6/1972 | Forman | 206/616 |

*Primary Examiner*—Stephen P. Garbe

*Attorney, Agent, or Firm*—Jordan and Hamburg

[57] ABSTRACT

An easy-to-open synthetic resin bag comprising: a bag body constituted by a laminated film formed by laminating several layers of synthetic resin film; a tear string bonded to part of an inner surface of the bag body corresponding to the opening thereof; and a tab formed at an end of the tear string; whereby pulling the tear string by the tab enables one side surface of the bag to be torn open, thereby allowing the bag to be opened. Also disclosed is a bag manufacturing apparatus capable of automatically bonding the tear string to the part of the inner surface of the bag body corresponding to the opening thereof when the bag body is being formed by employing the laminated film of the above kind.

2 Claims, 20 Drawing Figures

EASY-TO-OPEN SYNTHETIC RESIN BAG AND APPARATUS FOR THE MANUFACTURE THEREOF

This is a continuation of application Ser. No. 464,991, filed Feb. 8, 1983, and now abandoned.

BRIEF SUMMARY OF THE INVENTION

In a conventional bag having a bag body constituted by placing two laminated films formed by laminating together several layers of synthetic resin film over each other and heat-sealing the peripheral edges thereof, when part of the bag body is opened in order to remove the contents, since the bag body is constituted by laminated films, the bag body is difficult to tear and hence the opening process is difficult.

The present invention relates to an easy-to-open synthetic resin bag comprising: a bag body constituted by a laminated film formed by laminating synthetic resin films; a tear string bonded to part of the inner surface of the bag body corresponding to the opening thereof; and a tab formed over an end of the tear string, whereby pulling the tear string by the tab enables the side surface to which the tear string is bonded to be easily and surely torn, thereby allowing the bag body to be easily and speedily opened. The invention also pertains to a bag-manufacturing apparatus capable of continuously bonding the tear string with tabs provided at the ends thereof to the inner surfaces of the bag bodies in the bag body manufacturing process.

DETAILED DESCRIPTION OF THE PREFERRED EMBODIMENT

Figure 1:
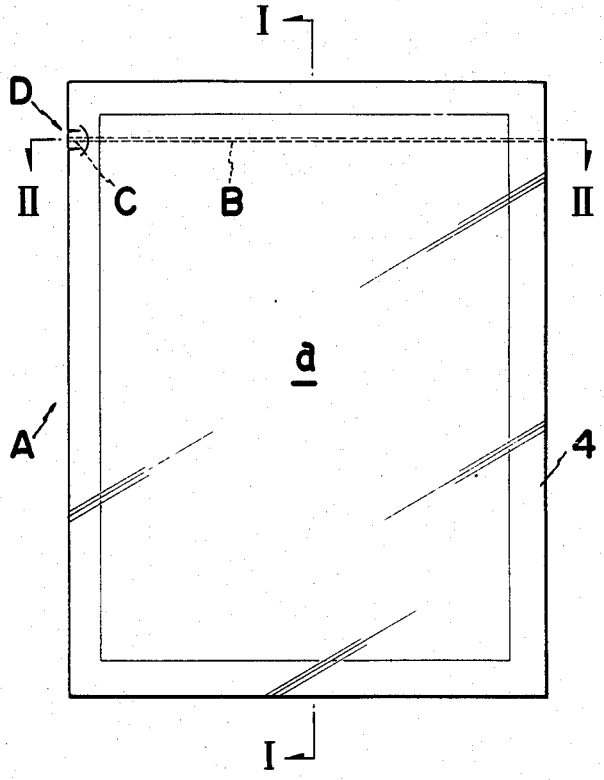
FIG. 1 is a front elevation of an easy-to-open synthetic resin bag in accordance with a preferred embodiment of the invention.
Figure 2:
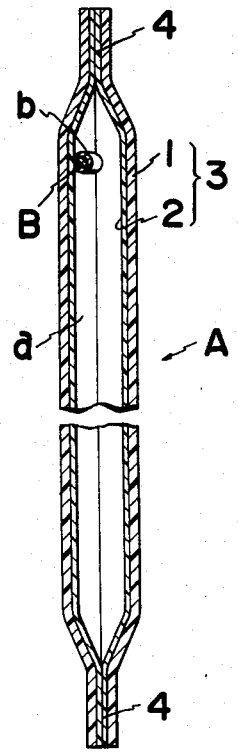
FIG. 2 is a section taken along the line I—I of FIG. 1.
Figure 3:
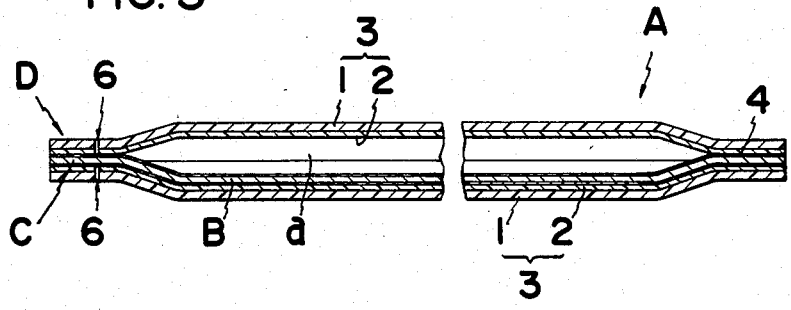
FIG. 3 is a section taken along the line II—II of FIG. 1.

As shown in FIGS. 1 and 2, a synthetic resin bag body A is constituted by a laminated film formed by laminating together the required number of layers of synthetic resin film. A base film 1 comprising one or more layers has a heat-sealable plastic film layer 2 laminated on the inner surface thereof. Two laminated films 3 each constituted by laminating together the base film 1 and the heat-sealable plastic film layer 2 are placed with the heat-sealable plastic film layers 2 facing each other, and the peripheral edges of the laminated films 3 are subjected to ultrasonic or heat sealing to constitute the bag body A. Reference numeral 4 denotes the heat-sealed edges.

A synthetic resin material having such properties as moisture resistance, heat resistance and an ultraviolet-screening property is employed as the base film 1. For the heat-sealable plastic film layer 2, it is possible to employ any material which enables the welding of the heat-sealable plastic film layers 2 to each other when the peripheral edges of the bag body A are subjected to ultrasonic or heat sealing.

The position of the opening of synthetic resin bag body A constituted by the laminated film with the arrangement as described above is defined by a tear string B bonded to one inner surface of the bag body A, i.e., one of the heat-sealable plastic film layers 2, as shown in FIG. 2.

It is possible to employ any kind of synthetic resin thread, natural thread or metal wire thread for the tear string B, and it can be either a single thread or a twisted yarn.

In order to bond the tear string B of this kind to the inner surface of the heat-sealable plastic film layer 2, such methods as follows can be used: the outer surface of the tear string B is formed of a heat-sealable resin, thereby enabling the heat-bonding thereof; the tear string B is formed of a twisted yarn consisting of heat-sealable fibers, thereby enabling the heat-bonding thereof; or the surface of the tear string B is coated with a heat-sealable resin b as shown in FIG. 2, thereby enabling the simple bonding of the string to the heat-sealable plastic film layer 2 on heating.

Figure 12:
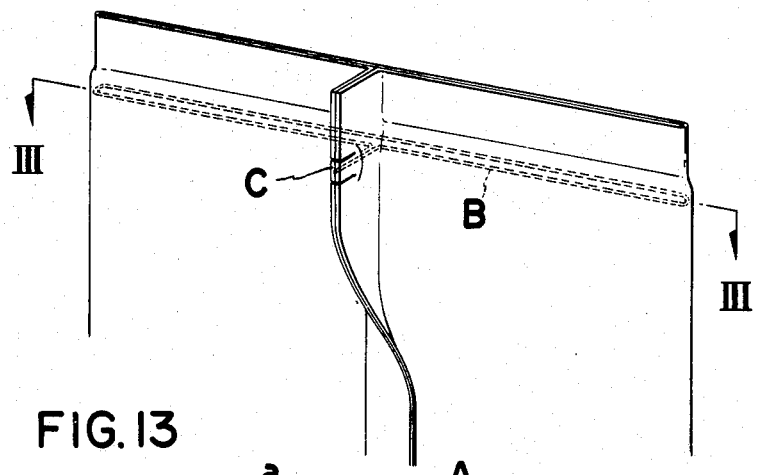
FIG. 12 is a perspective view of a bag body of an easy-to-open synthetic resin bag in accordance with another preferred embodiment of the invention.
Figure 13:
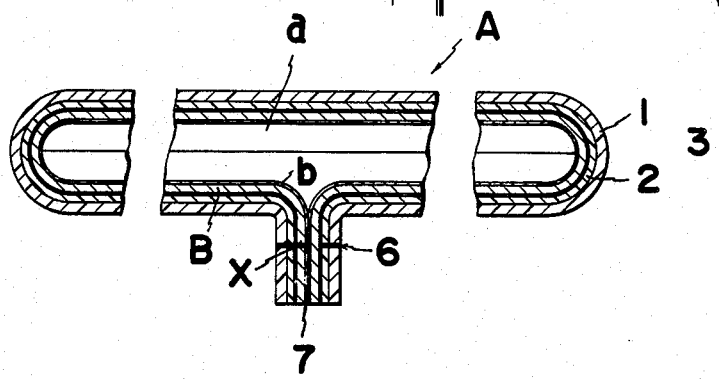
FIG. 13 is an enlarged section taken along the line III—III of FIG. 12.

It must be noted that besides the embodiment wherein the tear string B is bonded to one side wall of the bag body A, the tear string B can be bonded all around both side walls when the bag is flat as shown in FIGS. 12 and 13. The end C of the tear string B is clamped between the peripheral edges of the laminated films 3 placed over each other. The end C of the tear string B is provided with a tab D, which has the following structure.

Figure 4:
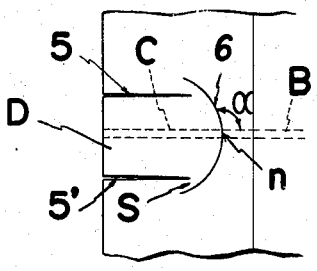
FIG. 4 illustrates a slit or opening formed in a tab part of the bag body of the easy-to-open synthetic resin bag of FIG. 1.

As shown at FIG. 4, side notches 5, 5' are formed on both sides of the end C in the pulling direction thereof. A slit opening in the form of an arcuate slit 6 is formed crossing the tear string B, with a certain space S provided between the transverse groove 6 and the ends of the notches 5, 5', so that the tab D is formed by the side notches 5, 5' and the slit 6.

The space S provided between the ends of the notches 5, 5' and the transverse groove 6 is to allow the tab D between the side notches 5, 5' to be supported by the heat-sealed edge 4 at the peripheral edge of the bag body, and the ends of the slit 6 are positioned so as to be at least outside the ends of the corresponding side notches 5, 5'. Thereby, if the tear lines deviate during in the process of tearing through the spaces S from the ends of the side notches 5, 5', the tear lines will inevitably reach the slit 6.

It is desirable that the angle $\alpha$ between the inner edge of opening or slit 6 6 and the tear string B toward the interior a of the bag body A should be at least more than 90°. If the angle is less than 90°, the force applied when tearing cannot be concentrated on the area n which is the intersection between the tear string B and the slit 6, so that it becomes difficult for the tear string B to tear through the laminated film 3 smoothly.

Other configurations of the opening or slit are shown in FIGS. 5 to 9.

Figure 5:
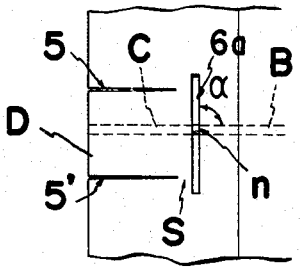

In FIG. 5 the opening is a narrow rectangular opening *6a*.

Figure 6:
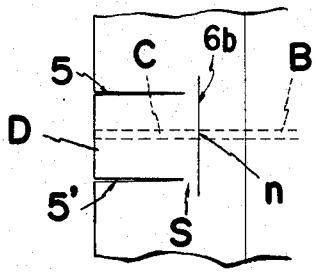

In FIG. 6 the opening *6b* is a straight or rectilinear slit.

Figure 7:
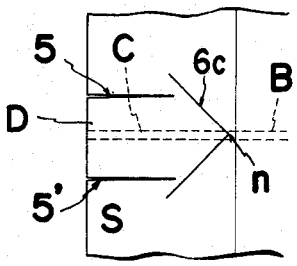
FIGS. 5 through 9 illustrate other embodiments of a slit or opening for the tab.

In FIG. 7 the opening *6c* is chevron-shaped, being constituted of two slits which meet at an apex.

Figure 8:
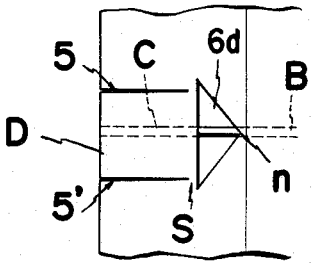

In FIG. 8 the opening *6d* is a triangular opening.

Figure 9:
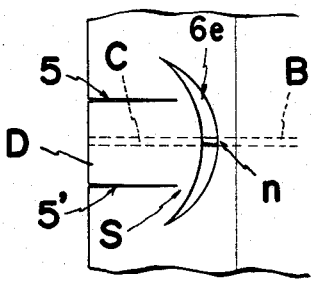
Figure 10:
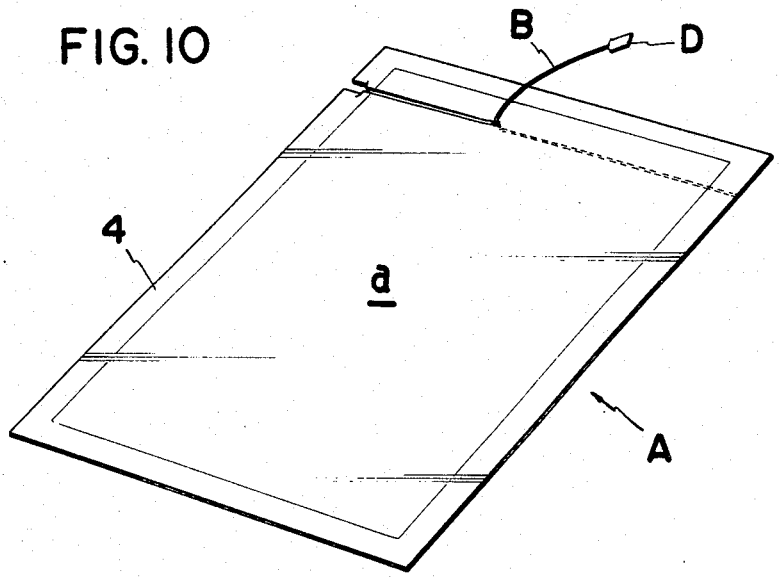
FIG. 10 is a perspective view of the easy-to-open synthetic resin bag of FIG. 1 in which the tear string thereof is being pulled.
Figure 11:
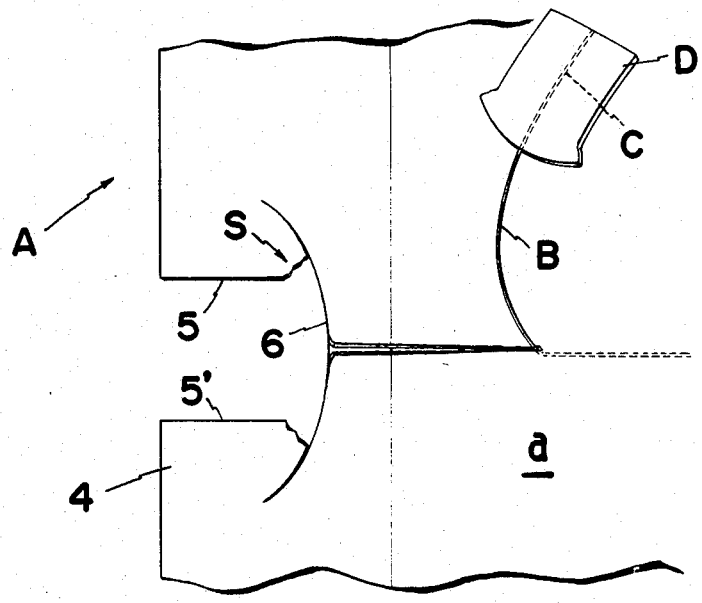
FIG. 11 illustrates the tab.

In FIG. 9 the opening *6e* is crescent-shaped.

Figure 14:
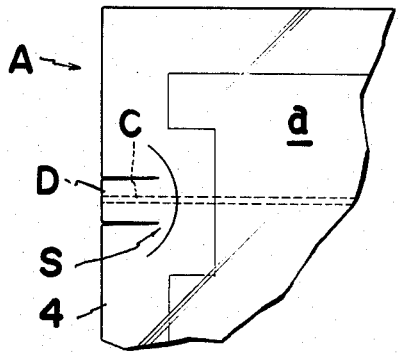
FIG. 14 illustrates another embodiment of the tab.

The bag body A shown in FIGS. 12–14 is formed in such a way that the edges of a flat laminated film 3 are first laid over each other, the doubled edge is subjected to heat sealing in order to form the laminated film 3 into a tubular shape, and then the upper and lower ends thereof are sealed to obtain a hermetically sealed bag. Side notches 5, 5' and a curved slit 6 which are similar to those shown in FIG. 4 are formed in the edge of the overlapped seal 7, and the tab D is formed over the end C of the tear string B.

In such a folded bag, since the end C of the tear string B overlaps the other end C, one of the tear string ends C is cut at a place corresponding to the curved slit 6 (i.e. at X). Therefore, pulling the tab D enables the pulling of only the tear string B on the other side to tear open the bag body.

The side notches 5, 5' and the curved slit 6 are formed at both edges of the flat laminated film 3 before forming the overlapped seal 7, and the ends of the laminated film 3 are laid over each other to form the overlapped seal 7. In this case, each of the side notches 5, 5' and the opening 6 is formed, not as a slit along a line, but as a notch or opening with a rather larger width, thereby absorbing any slight offset in the positions when the right and left edges are laid over each other, and thus allowing the notches and openings in the right and left edges to align with each other.

It must be noted that when the width of the heat-sealed edge 4 is narrow, the part of the heat-sealed edge 4 around the slit or opening 6 is formed to have a wider width as shown in FIG. 14.

Figure 15:
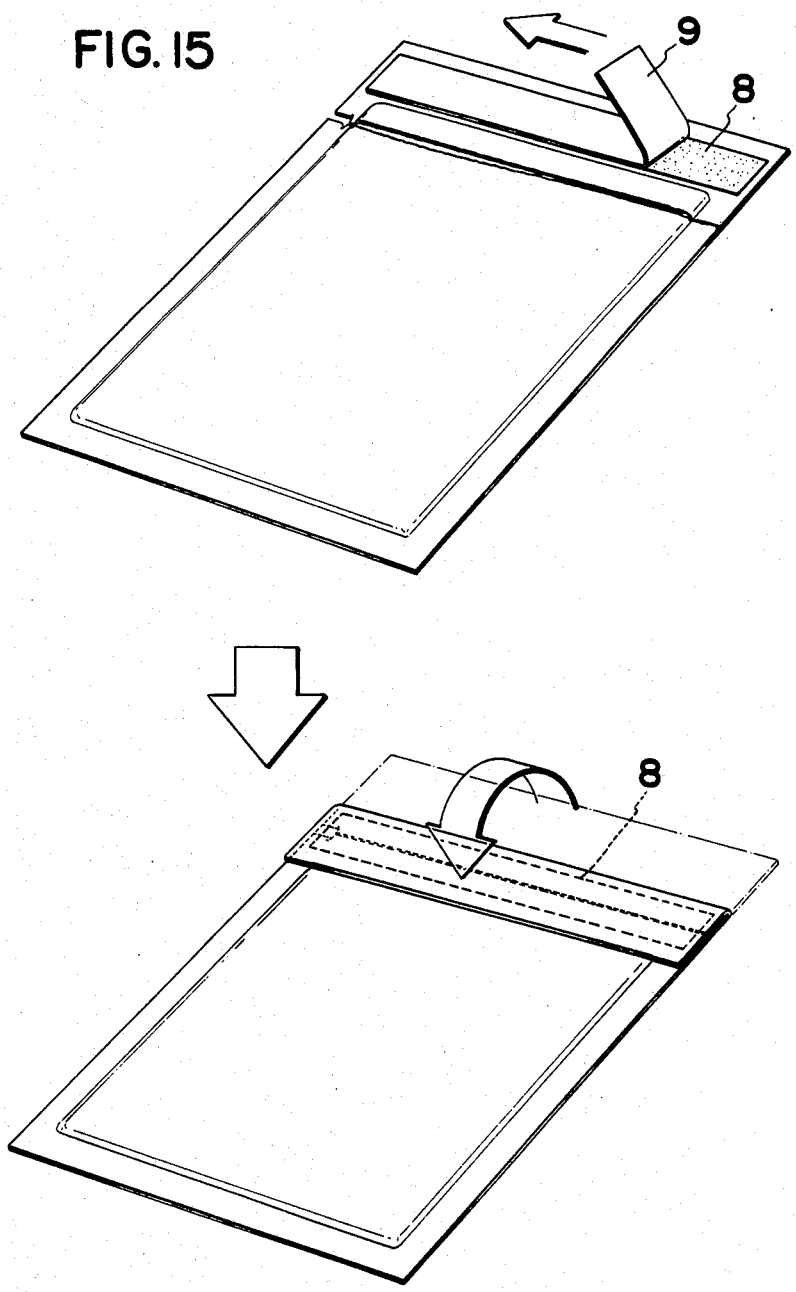
FIG. 15 illustrates an easy-to-open synthetic resin bag of the invention in which a layer of bonding agent is provided on the bag body.
Figure 16:
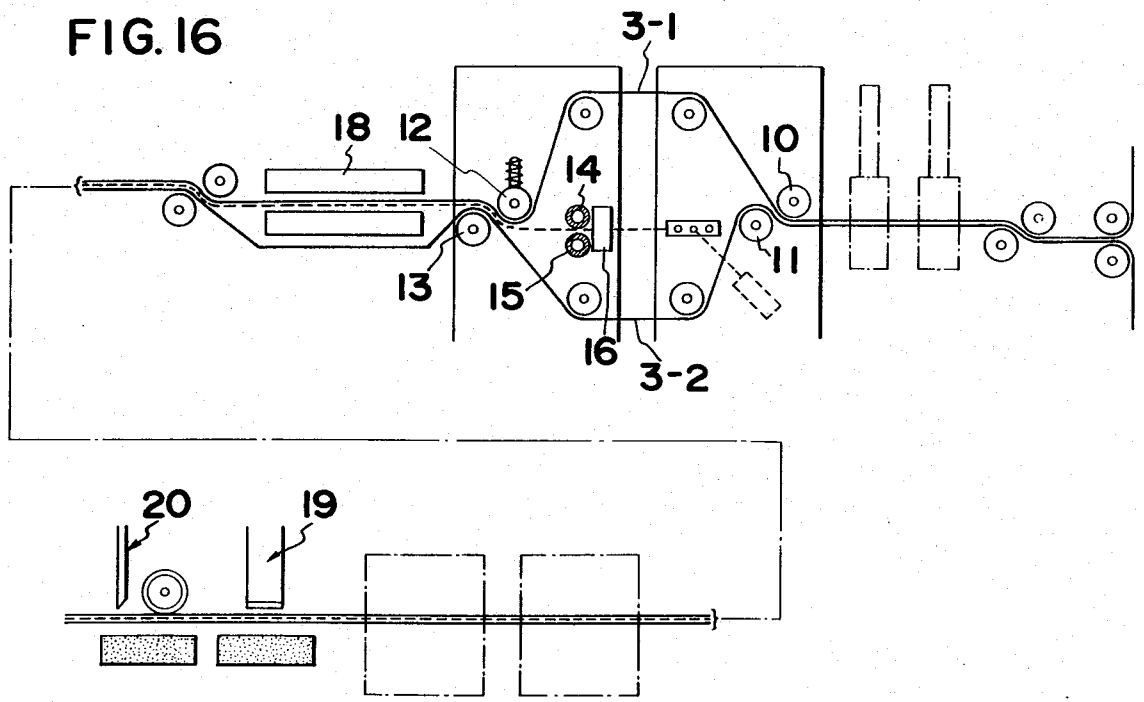
FIG. 16 illustrates the complete apparatus for manufacturing the easy-to-open synthetic resin bag of the invention.

FIG. 15 shows a bonding agent 8 applied to the part of the bag body A above the opening thereof, with a peel-off strip 9 removably attached to the bonding agent 8, which is used for closing the opening by bending over the upper part of the bag body A after it has been opened by pulling the tear string B.

An apparatus for manufacturing the above easy-to-open synthetic resin bags shown in FIG. 1 will be described below.

This bag-manufacturing apparatus is constructed as shown in FIGS. 16 through 20. In other words, upper and lower separating rollers 10, 11 are provided facing each other so as to separate vertically an upper continuous laminated film 3-1 which will be the upper surface of the bag body from a lower continuous laminated film 3-2 which will be the lower surface of the bag body. On the downstream side of the separating rollers 10, 11 as viewed in the direction of flow of the films, rollers 12, 13 are provided which again superimpose the upper and lower laminated films 3-1, 3-2 which were vertically separated from each other, and two pipes 14, 15 can be horizontally displaced in the space between the vertically separated laminated films 3-1, 3-2. Tear string-positioning members 16 are slidably attached to the pipes 14, 15. The tear string-positioning members 16 each have a hole 17 for receiving tear strings B-1 pulled from the side. The tear strings B-1 passing through the receiving holes 17 are positioned by the lateral sliding of the tear string-positioning members 16, thereby allowing tear strings B-1 to be sandwiched between the upper and lower laminated films 3-1, 3-2. The upper and lower laminated films 3-1, 3-2 are superimposed, sandwiching between them the tear strings B-1, by means of the rollers 12, 13, are separated vertically again, and then the tear strings B-1 and the upper laminated film 3-1 are bonded together by means of a heat-bonding means 18.

On the downstream side of the heat-bonding means 18, a bag making means 19 and a cutting means 20 are provided for heat-sealing and cutting the bag edges, thereby manufacturing the bags.

Figure 17:
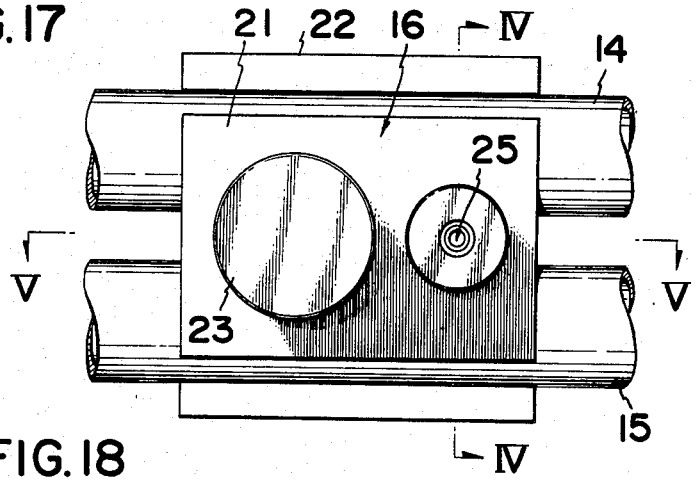
FIG. 17 is a front elevation of a tear string-positioning member of the apparatus shown in FIG. 16.
Figure 18:
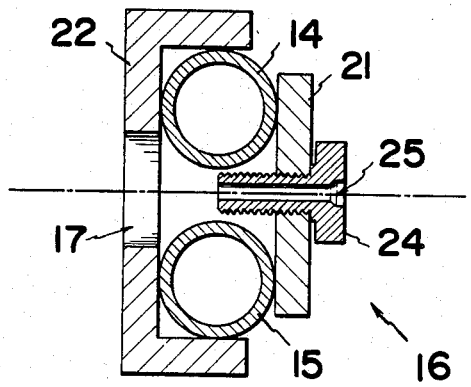
FIG. 18 is a section taken along the line IV—IV of FIG. 17.
Figure 19:
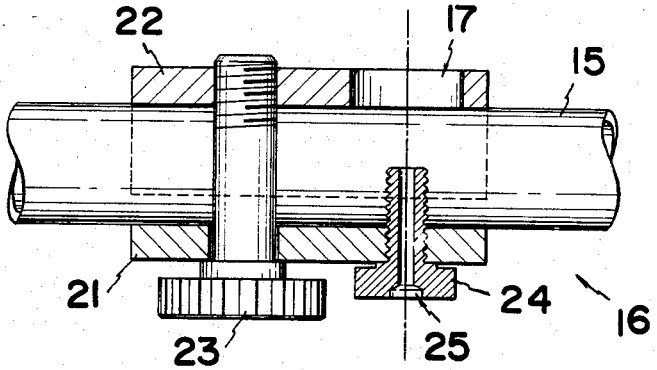
FIG. 19 is a section taken along the line V—V of FIG. 17.
Figure 20:
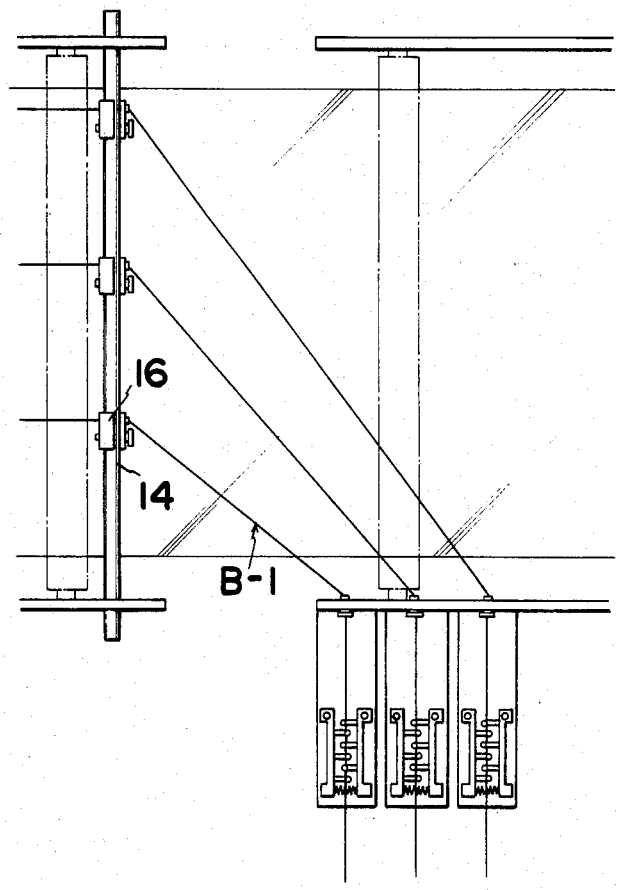
FIG. 20 is a plan view of the essential parts of the apparatus shown in FIG. 16.

The tear string-positioning members 16 will be described below in greater detail. As shown in FIGS. 17 through 19, the two pipes 14, 15 are arranged so as to be clamped by a front plate 21 and a rear plate 22 and fastened by means of a fixing bolt 23. A bolt 24 with an axial hole 25 is screwed into the front plate 21 so as to pass between the pipes 14, 15.

A tear string B-1 is inserted through the hole 25 of the bolt 24, passed between the pipes 14, 15 and led from a receiving hole 17 formed in the rear plate 22.

A puncher 26, which is provided on the downstream side of the separating rollers 10, 11, has the function of applying the transverse grooves 6 to the previously overlapped laminated films 3-1, 3-2 in order to form the tab D.

The side notches 5, 5' constituting the tab D are formed by the cutting means 20 simultaneously with the cutting of the continuous bag body A.

Since the invention is arranged as described above, in order to remove the contents of the bag body A, pulling the tab D formed in the heat sealed edge 4 around the peripheral edge of the bag body A causes the tear string B to tear through the laminated film 3 forming the upper surface of the bag body A to open the bag. Accordingly, it is possible to obtain the effect that the bag body A can be easily and surely opened along the tear string B.

Moreover, when manufacturing continuously bag bodies A of the above type, the continuous laminated films 3-1, 3-2 are vertically separated by means of the separating rollers 10, 11, respectively, and the tear string B is led into the space therebetween from the tear string-positioning member 16 and is sandwiched between the upper and lower laminated films 3-1, 3-2 and then bonded to the upper laminated film 3-1 by means of the heat-bonding means 18, thereby allowing the bag bodies A to be manufactured continuously.

What is claimed is:

1. An easy-to-open synthetic resin bag comprised of opposed walls, each of which is formed from several laminated layers of synthetic resin film, said walls being bonded together around the periphery thereof to form a sealed border region around the periphery of an unbonded interior of the bag, a tear string extending along a line corresponding to an opening to be formed in the bag, said tear string having a portion within the unbonded interior of the bag being heatbonded to an inside surface of only one wall and end portions within said border region being heatbonded between said opposed walls, notches formed in said border region at opposite sides of the end of said tear string, said notches having outer ends extending to an outer edge of the border region and inner ends terminating in the border region at a location spaced outwardly of the unbonded interior of the bag, said bag body having an opening in the bonded border region of the walls which is transverse to the length of the string and between the interior of the bag and the inner ends of said notches, said opening being adjacent to but spaced from the inner ends of said notches, and said string extending between said notches and across said opening, said notches and opening defining a tab with a tear away portion between said inner ends of the notches and said opening in said bonded border region, said opening having a length in a direction transverse to the length of the string at least as great as the distance between the inner ends of the notches, said opening having an inner edge closest to the unbonded interior of the bag which makes an angle $\alpha$ of at least more than 90 degrees with the string as measured from the opening edge toward the interior of the body, so that the tab tears into the opening and the string is directed by the opening to tear along said one wall of the bag when said tab is grasped and pulled.

2. An easy-to-open bag according to claim 1, further comprising, a bonding agent above said tear string of the bag with a peel-off strip attached to the bonding agent, to enable closing the opening formed by the tear string, by removing the peel-off strip and folding the upper part of the bag over the tear string opening.

* * * * *